United States Patent [19]

Kashio

[11] 4,428,681

[45] Jan. 31, 1984

[54] DATE DISPLAY DEVICE

[75] Inventor: Toshio Kashio, Tokyo, Japan

[73] Assignee: Casio Computer Co. Ltd., Tokyo, Japan

[21] Appl. No.: 103,222

[22] Filed: Dec. 13, 1979

[30] Foreign Application Priority Data

Dec. 25, 1978 [JP] Japan ..... 53-160364

[51] Int. Cl.[3] ..... G04B 19/22; G04B 19/24

[52] U.S. Cl. ..... 368/21; 368/29; 340/756

[58] Field of Search ..... 368/28-30, 368/41-43, 82-84, 72-73, 239-242, 250-251, 21, 22; 40/107; 340/756

[56] References Cited

U.S. PATENT DOCUMENTS

| | | | |
|---|---|---|---|
| 4,104,865 | 8/1978 | Sasaki | 368/251 |
| 4,162,610 | 7/1979 | Levine | 368/28 |
| 4,180,969 | 1/1980 | Naito | 368/28 |
| 4,193,255 | 3/1980 | Ebihara et al. | 368/34 |
| 4,205,516 | 6/1980 | Terao | 368/29 |
| 4,214,433 | 7/1980 | Terao | 368/28 |
| 4,233,681 | 11/1980 | Murata | 368/242 |
| 4,270,192 | 5/1981 | Kudo | 368/29 |

*Primary Examiner*—Vit W. Miska

*Attorney, Agent, or Firm*—Frishauf, Holtz, Goodman & Woodward

[57] ABSTRACT

The data display device has a memory section to store a specific day or days for different countries or regions of the world. The specific day data read out from the memory section, and which is peculiar to a specific country or region, is transferred to a display section to be displayed thereby.

9 Claims, 10 Drawing Figures

DATE DISPLAY DEVICE

BACKGROUND OF THE INVENTION

This invention relates to a date display device capable of displaying the date data peculiar to global regions such as countries.

Electronic devices with date display devices such as electronic timepieces with calendars are known. This type of timepiece has a calendar in which the dates falling on, for example, Sundays are indicated in special fashion. Further, instead of the calendar of the current month, the calendar of the preceding month or the next month, for example, may be displayed. In scheduling day's or week's programs of business by using such a calendar display device, it is very convenient if specific days such as holidays of each month can be specially indicated. For those persons travelling worldwide, it is frequently required to know specific dates such as holidays in the respective countries. However, as far as the applicant knows, a timepiece with such a display function has never been put into practical use.

Accordingly, an object of the invention is to provide a date display device capable of displaying a specific day or days of a specified month when it is used for displaying the calendar of the specified month.

Another object of the invention is to provide a date display device capable of displaying the date data peculiar to each region.

SUMMARY OF THE INVENTION

A date display device of the present invention comprises a specific date memory means for storing date data of specific days including the holidays of a plurality of different local districts; district select means for selecting a specific district from among the plurality of different local districts; date data reading means for reading from the specific date memory means the date data of the specific days of the local district which is selected by said district select means; and date display means for displaying the date data of the specific days which is read out by the action of the date data reading means.

With such a construction, special days such as holidays in any specific region in the world may be indicated in special fashion, and the user can easily know the special day or days of the specified month. Thus, the use of the date display device of the invention facilitates making business schedules. The date display device can display various kinds of data.

DETAILED DESCRIPTION

Figure 1:
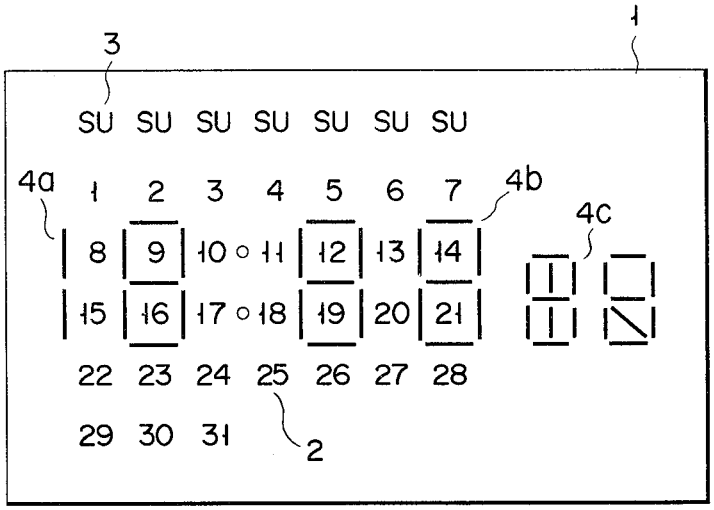
FIG. 1 shows a display arrangement of a display section of an electronic timepiece embodying the invention.

Referring to FIG. 1, in a display section 1 of a display device according to the invention, numerals 1 to 31 representing dates are arranged in a matrix fashion of 5 in rows×7 in columns, thereby forming a calendar table 2. Seven day-of-week display elements 3, such as "SU", are disposed on the upper portion of the calendar table 2. Three sets of segment display element pairs 4*a* to 4*c* for displaying digital data are disposed partially overlapping with the area of the calendar table 2. The display elements 4*c* are used to display characters various digital data and the days of week, such as the characters "SU", "MO", "TU", "WE", "TH", "FR", "SA" and the like. The display elements 4*c* are smaller than those of the remaining ones 4*a* and 4*b* and are disposed outside the display area of the calendar table 2.

Figure 2:
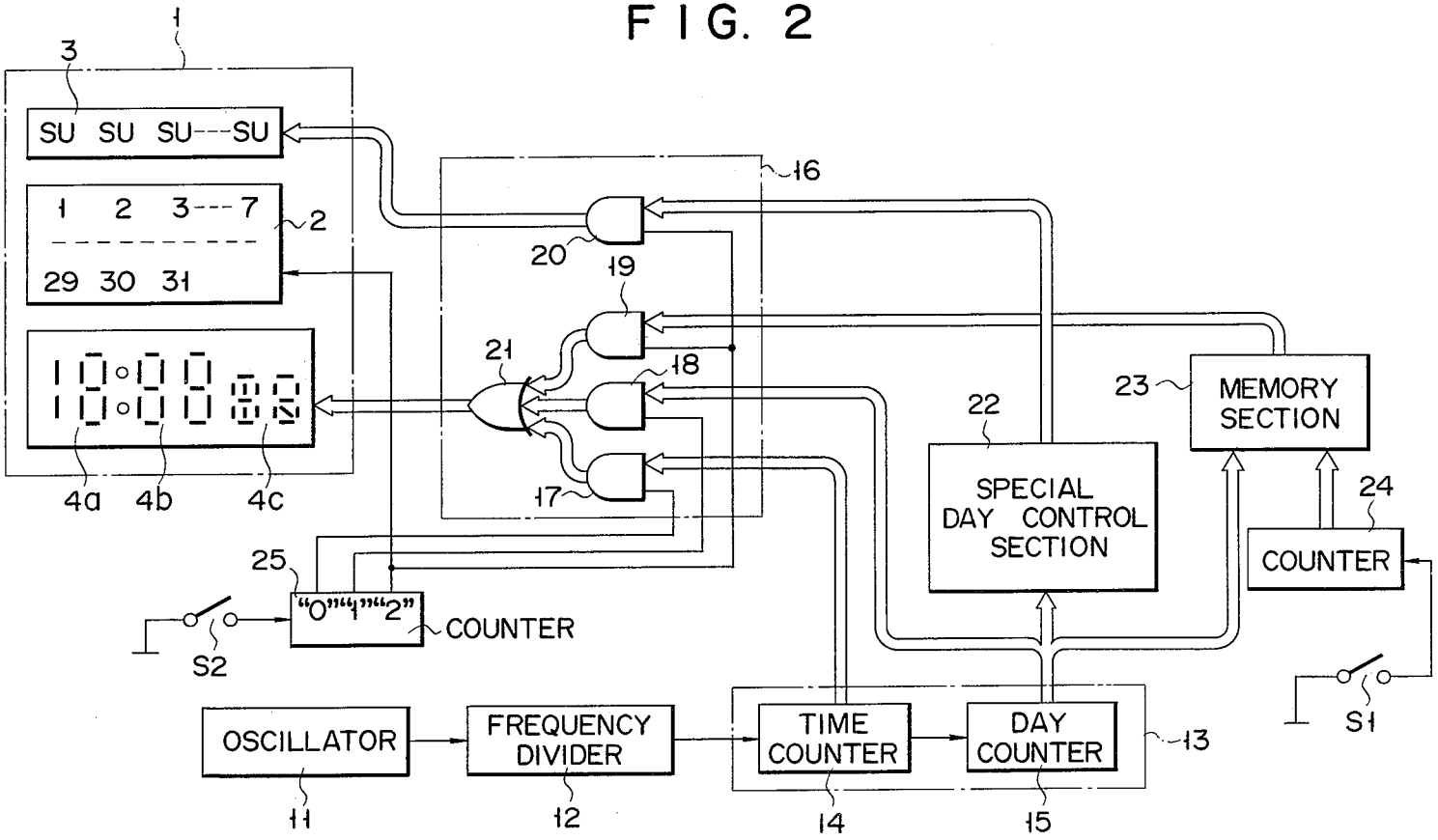
FIG. 2 shows a block diagram of a circuit construction of the electronic timepiece embodying the invention.

Turning now to FIG. 2, there is shown a circuit construction supplying display data to the display section 1. In FIG. 2, an oscillator circuit 11, for example, a crystal oscillator, produces a reference signal. The output signal from the oscillator circuit 11 is frequency-divided by a frequency divider 12 and the frequency divided one is supplied to a time counter circuit 13 includes a time counter 14 to count a signal derived from the frequency divider 12 to provide the time data of hour, minute and second and a day counter 15 to count a signal given for each day to provide date date of month, day and the day of week. The time count data produced from the time count circuit 13 is applied to a display control section 16. The display control section 16 is comprised of AND gates 17 to 20 and an OR circuit 21, for example. The output data from the time counter 14 is applied to the AND gate 17 and the output data from the date counter 15 is inputted to the AND gate 18. The output data from the date counter 16 is applied to a reference day-of-week control section 22 and a memory section 23. The reference day-of-week control section 22 is used to obtain the reference day-of-week data of the month, i.e. column data to indicate what column of the calendar table 2 represents Sunday, from the day-of-week data and day data supplied from the date counter 15. The reference day-of-week data is inputted to the AND circuit 20 of the display control section 16. The output signal produced from a region specifying switch S1 when it is operated, is applied as a count-up signal to the scale-of-n counter 24. The scale n count corresponding to the desired region is set in the counter 24 and the contents of the counter 24 is applied to the memory section 23 which will be described later. The memory section 23 stores the date data peculiar to the respective regions. The counter 24 specifies a desired region to cause the memory section 23 to produce the date data corresponding to the region specified which in turn is applied to the AND circuit 19 of the display control section 16. A display change switch S2 produces an output signal which is applied as a count-up signal to a display change counter 25. When the contents of the counter 25 is a numerical value "0", the output signal of the counter 25 is applied to the AND circuit 17 of the display control section 16. When it is "1", the output signal thereof is applied to the AND circuit 18. When it is "2", the output signal is applied to the AND gates 19 and 20. In this case, the output signal serves as a gate control signal. The output signals from the AND gates 17 to 19 are applied through the OR gate 21 to the display segments 4*a* to 4*c*. The output signal from the AND gate 20 is applied as a drive signal to the day-of-week display element 3. The output signal of the counter 25 when it has "2" is applied as a drive signal of the calendar table to the display section 1.

Figure 3:
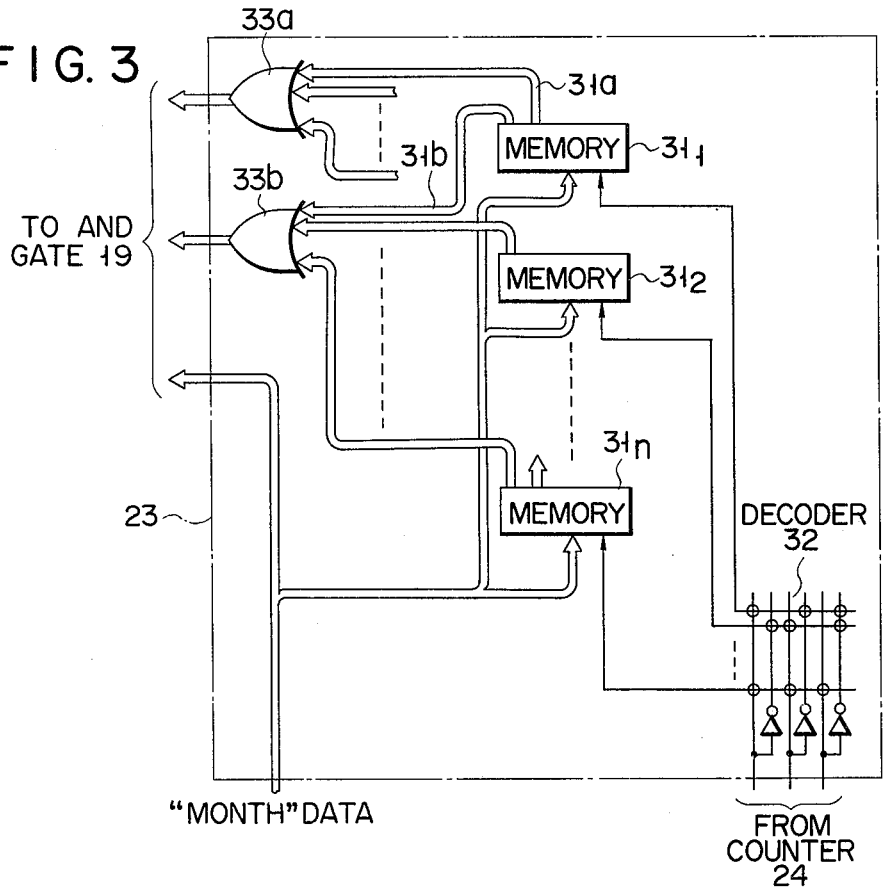
FIG. 3 shows a block diagram of a memory section of the circuit shown in FIG. 2.

The details of the memory section 23 will be described with reference to FIG. 3. In FIG. 3, memories $31_1$ to $31_n$ provided corresponding to the respective regions store the specific days such as holidays peculiar to the regions. A decoder 32 decodes the count contents of the counter 24 to specify a desired memory of those memories $31_1$ to $31_n$. The month data is applied from the date counter 15 to the memories $31_1$ to $31_n$. Those memories produce the specific day data of the month when a given region is specified by the output signal from the decoder 32. Those memories $31_1$ to $31_n$ store each two specific days, for example, for each month and produce the specific data through the OR gates 33*a* and 33*b*, and is applied to an AND gate 19 of the display section 16, together with the month data from the date counter 15.

Figure 4:
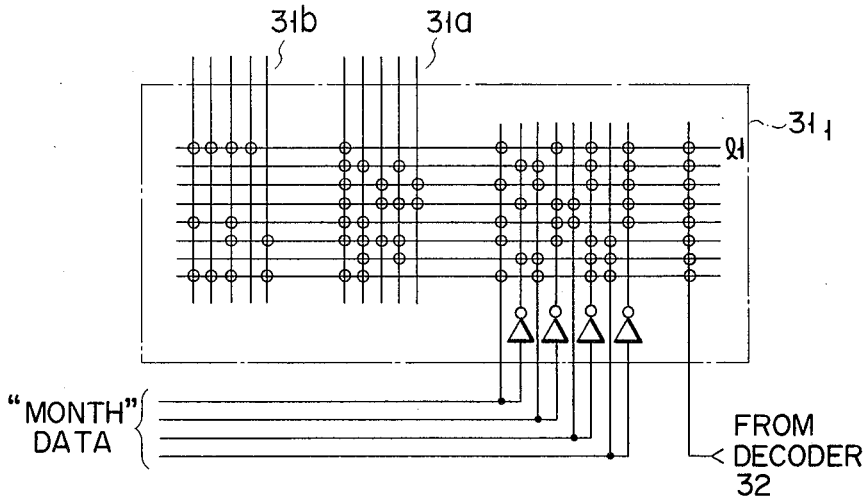
FIG. 4 shows a circuit diagram of each memory shown in FIG. 3.

The memories $31_1$ to $31_n$ are each constructed by a decoder 32, as shown in FIG. 4. When a specifying signal is applied to the memories those memories are rendered ready for the outputting of the data. Under this condition, each of the memories $31_1$ to $31_n$ produces the different specific day through the output lines 31*a* and 31*b* in accordance with the month data at that time. FIG. 4 shows an example of a memory construction of the memory $31_1$ when Japanese holidays are stored as specific day data to the memory.

To be more specific, the date counter 15 supplies the data of January to the memory $31_1$ to specify an output line $1_1$ thereof. Then, the memory $31_1$ outputs specific day data, January 1st (New Year's Day) and 15th (Coming-of-Age Day), through output lines 31*a* and 31*b*, respectively.

Figure 5A:
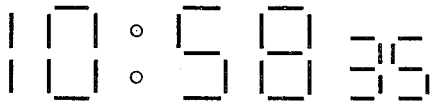
FIG. 5(A) shows a display of the time of day.

The operation of the embodiment thus constructed of the invention will be described. When the contents of the counter 25 is set to "0" by the display change switch S2, the AND circuit 17 is enabled and the time data "hour", "minute", and "second" output from the time counter 14 are transferred to the display section 1 to be displayed as "10:58:35", as shown in FIG. 5(A).

Figure 5B:
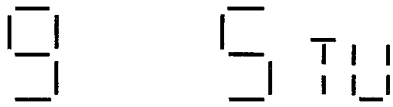
FIG. 5(B) shows a display of a date.

Under this condition, the contents of the counter 25 is set to "1" by operating the change switch S2, the AND gate 18 is enabled, so that the date data "month", "day", and "day-of-week" outputted from the date counter 15 are transferred to the display section 1 whereby to drive the segment display elements 4*a* to 4*c* to display "9 $5_{TU(Tuesday)}$", as shown in FIG. 5(B).

Figure 5C:
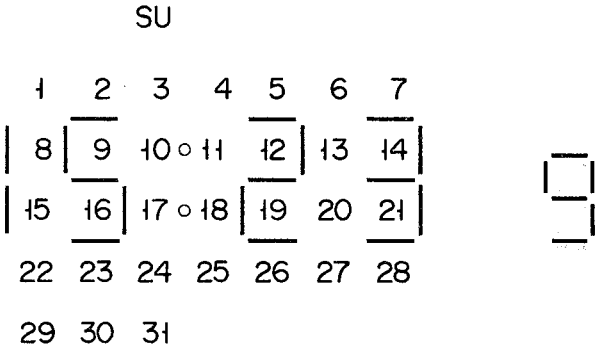
FIG. 5(C) shows a display of a calendar.
Figure 6:
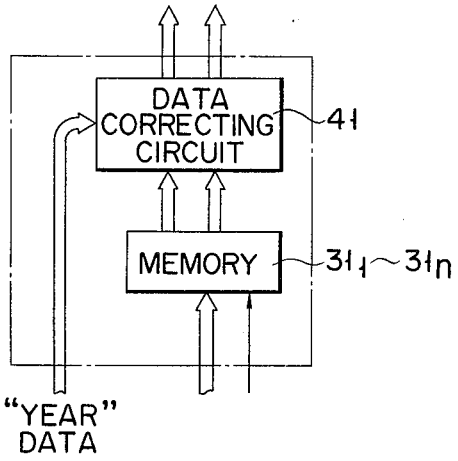
FIGS. 6 and 7 show circuit constructions of other embodiments of the memory section according to the invention.

When it is set to "2" by operating the change switch 2, a display drive signal is applied to the calendar table 2 where numerals 1 to 31 are displayed. Further, the output from the counter 25 enables the AND gates 19 and 20. Through this operation, the specific day data read out of the memory section 23 and the reference day-of-week data from the day-of-week control section 22 are both transferred to the display section 1. Consequently, as shown in FIG. 5(C), the date numerals 1 to 31 are displayed while at the same time the display element SU corresponding to the column having the day numeral 3 is visualized so as to form a calendar of September and further the segment display elements 4*a* to 4*c* cooperate to display the specific day. In this case, if the region specifying key S1 has specified "Tokyo", the memory section 23 produces the holidays of September in Japan, Respect-for-the-Aged Day (September 15) and Autumnal equinox day (September 23) whereby the segment display elements 4*a* and 4*b* displays the dates "15" and "23". The month data of September is displayed by the segment display element 4*c*. By operating the region specifying switch S1 to change the contents of the region counter 24, the region is specified in accordance with the contents of the counter, so that the memory section 23 produces the specific day data of the specified region.

When the specific days set in the memory section 23 change with year, such as Autumnal equinox day and vernal equinox day, a data correcting circuit 41 may be additionally coupled with the memories $31_1$ to $31_n$ and the indefinite specific days are corrected by applying the year data to the correcting circuit 41.

Figure 7:
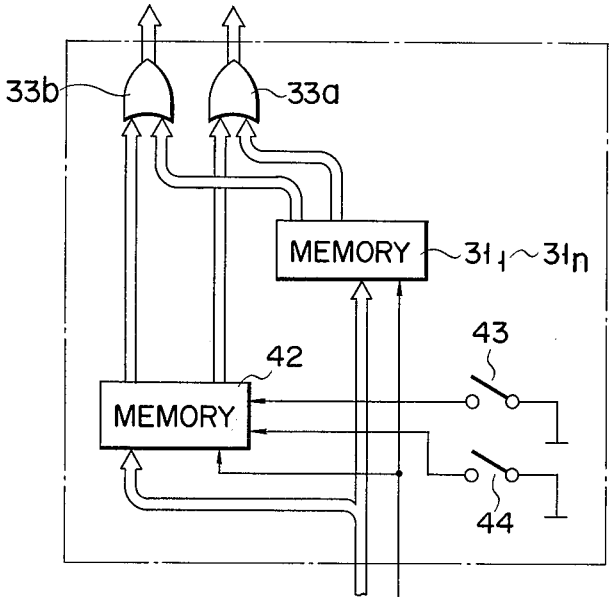

In the above-mentioned embodiment, the specific day data is fixedly stored in the memory section 23. As modification, a writable memory 42 is additionally provided to the memories $31_1$ to $31_n$, as shown in FIG. 7, and proper specific days such as birthdays and appointed days are stored thereinto by the month data setting switch 43 and the day data setting switch 44.

Figure 8:
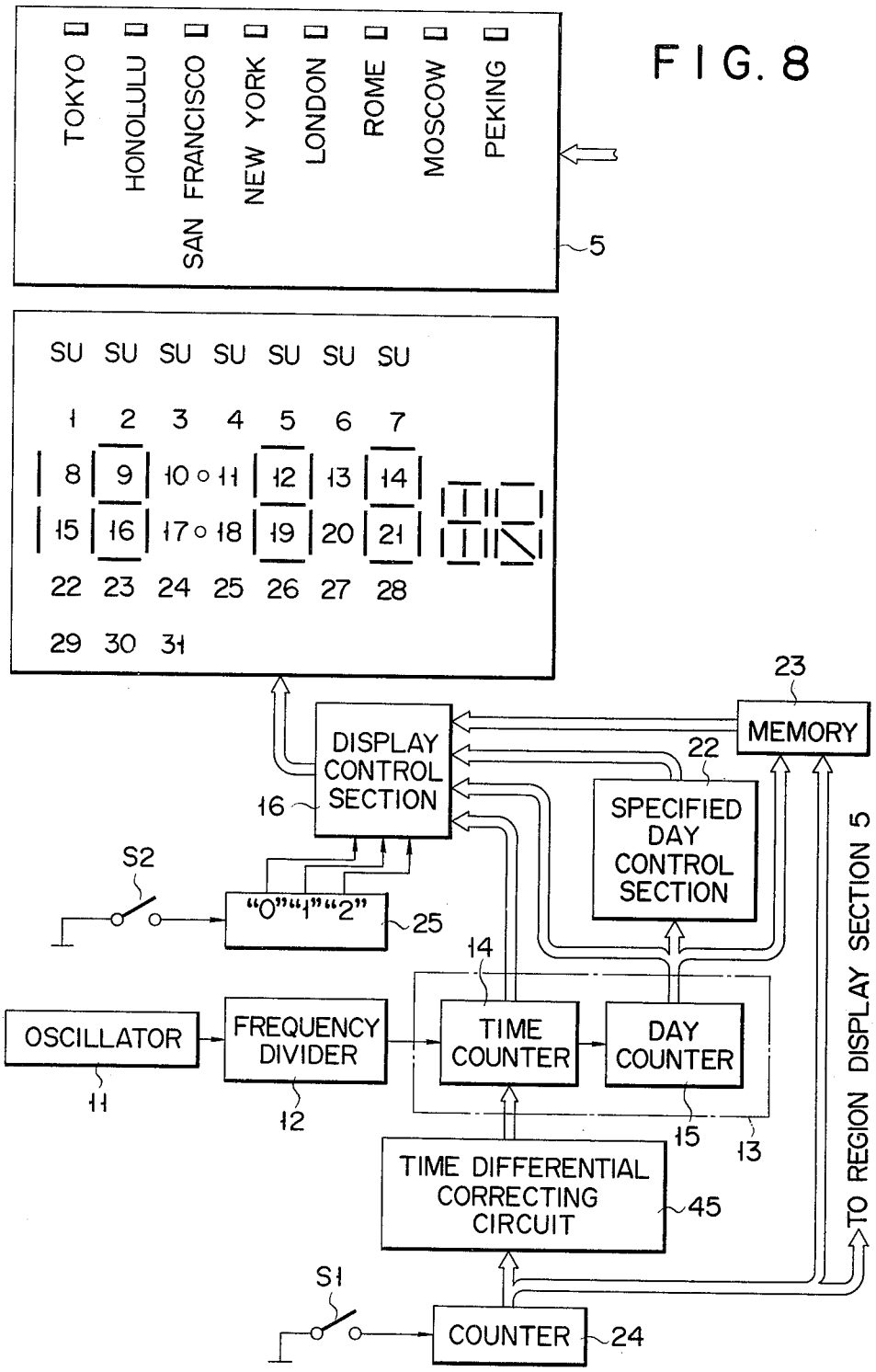
FIG. 8 shows a block diagram of another embodiment of a timepiece according to the invention.

When the invention is applied to the timepiece for displaying world time with the differences in time, the time differential correcting circuit 45 is used as shown in FIG. 8. The time of day of the time counter 14 is corrected in accordance with the region specifying data in the region counter 24 thereby to display the correct time of day of any region desired. In FIG. 8, the output of the region counter 24 is applied to the memory section 23 and the time differential correcting circuit 45, and further to the region display section 5 where the specified region is displayed.

In the above-mentioned embodiment, the date data peculiar to the region is digitally displayed. The date data may be displayed by the combination of sounds, for example. In addition to the electronic timepiece, the invention is applicable for other suitable devices such as electronic calculators.

What is claimed is:

1. A date display device comprising:

a specific date memory means for storing date data of specific days including the holidays of a plurality of different local districts;

district select means for selecting a specific district from among said plurality of different local districts;

date data reading means coupled to said district select means for reading from said specific date memory means the date data of the specific days of the local district which is selected by said district select means; and date display means coupled to said date data reading means for displaying the date data of the specific days which is read out by the action of said date data reading means.

2. The date display device of claim 1, wherein said specific date memory means includes:

a holiday memory section for fixedly storing the date data of the holidays of said plurality of different districts; and a memory section for storing the date data which can be set by a user at will.

3. The date display device of claim 1, wherein said district select means comprises a steppable counter means for producing an output for selecting said plurality of different districts in a predetermined sequence according to its step counts.

4. The date display device of claim 1, wherein said date display comprises a numerical value display element for displaying date data read from said specific date memory means as a numerical value.

5. The date display device of claim 1, wherein said date display means comprises:

a calendar display element for displaying the calendar of one month; and a specific date display element for displaying the date data of the specific day which is read out from said specific date memory means.

6. The date display device of claim 1, wherein said date display means comprises a month display element for displaying the month of the displayed specific date.

7. The date display device of claim 1, wherein said date display means comprises a district display element for displaying that the date being displayed is the specific date of a specified one of said plurality of different local districts.

8. The date display device of claim 1, wherein said district select means includes a manually operable switch means for manually selecting said specific district.

9. The date display device of claim 3, wherein said district select means further comprises a manually operable switch means coupled to said counter means for stepping the count of said counter means on each manual operation of said switch means to thereby select a specific one of said plurality of different districts.

* * * * *